United States Patent [19]

DeBruyn

[11] Patent Number: 4,716,622

[45] Date of Patent: Jan. 5, 1988

[54] CONCEALED SELF-CLOSING HINGE

[75] Inventor: William DeBruyn, Rockford, Ill.

[73] Assignee: Amerock Corporation, Rockford, Ill.

[21] Appl. No.: 833,168

[22] Filed: Feb. 27, 1986

[51] Int. Cl.[4] ..... E05F 1/08

[52] U.S. Cl. ..... 16/297; 16/319; 16/335

[58] Field of Search ..... 16/296, 335, 341, 277, 16/278, 297, 319, 321

[56] References Cited

U.S. PATENT DOCUMENTS

| | | | |
|---|---|---|---|
| 588,642 | 8/1897 | Hoffman . | |
| 3,237,239 | 3/1966 | Rudnick | 16/145 |
| 3,550,187 | 12/1970 | Swartz | 16/180 |
| 3,608,130 | 9/1971 | Rudnick | 16/335 |
| 3,623,185 | 11/1971 | Cartwright et al. | 16/142 |
| 3,864,786 | 2/1975 | Salice | 16/278 |
| 3,950,818 | 4/1976 | Holmes | 16/180 |
| 4,114,236 | 9/1978 | Vandervort | 16/335 |
| 4,177,540 | 12/1979 | Gorton | 16/335 |
| 4,226,001 | 10/1980 | Salice | 16/296 |
| 4,247,965 | 2/1981 | Lautenschlager | 16/296 |
| 4,347,645 | 9/1982 | Iseki | 16/291 |
| 4,506,409 | 3/1985 | Lautenschlager | 16/238 |

FOREIGN PATENT DOCUMENTS

| | | | |
|---|---|---|---|
| 2658514 | 6/1978 | Fed. Rep. of Germany | 16/335 |

*Primary Examiner*—E. R. Kazenske
*Assistant Examiner*—James L. Wolfe
*Attorney, Agent, or Firm*—Leydig, Voit & Mayer

[57] ABSTRACT

The door member of a self-closing hinge includes a cup which is concealed within a pocket formed in the inner side of a door. A curl on the frame member of the hinge pivotally receives a hinge pin which is carried by the cup. To effect the self-closing action, a leaf spring is mounted on the outer side of the end wall of the cup and includes a tongue which extends through an opening in the end wall and into resilient bearing engagement with the curl.

2 Claims, 9 Drawing Figures

CONCEALED SELF-CLOSING HINGE

BACKGROUND OF THE INVENTION

This invention relates in general to a self-closing hinge for mounting a cabinet door for swinging between open and closed positions on a cabinet frame. Such a hinge customarily includes door and frame members mountable on the door and frame, respectively, and interconnected by a hinge pin on the door member. Spring means are carried by the door member of the hinge and act against a curl which receives the hinge pin and which is part of the frame member of the hinge. After the door has been swung a predetermined distance from its open position toward its closed position, the spring means cause the door to swing the rest of the way closed and resiliently hold the door in its closed position.

More specifically, the invention relates to a concealed self-closing hinge of the same general type as disclosed in Lautenschlager U.S. Pat. No. 4,506,409. In such a hinge, the door member is, for the most part, formed by a cup which is adapted to nest within a pocket formed in the inner side of the door. The hinge pin is carried by the cup and is connected to the frame member of the hinge in such a manner that, when the door is fully closed, virtually all parts of the hinge are concealed from view from the front of the cabinet.

In concealed self-closing hinges of the type disclosed in the Lautenschlager patent, the spring means for effecting self-closing of the door are rather bulky, complex and expensive. Most such hinges require a roller or plunger means and require one or more coil springs for urging the roller or plunger means against the curl on the hinge pin.

SUMMARY OF THE INVENTION

The general aim of the present invention is to provide a new and improved concealed self-closing hinge of the cup-type in which the spring for effecting the closing action is of simple and inexpensive one-piece construction, is supported in a very compact manner by the cup and acts directly on the curl on the hinge pin without requiring the use of intermediate rollers, plungers or the like.

A more detailed object of the invention is to achieve the foregoing by providing a hinge in which the spring means is in the form of a simple leaf spring having a substantially flat mounting plate which lies in compact face-to-face relation with the outer side of the end wall of the cup. Formed integrally with the mounting plate of the spring is an elongated tongue which extends inwardly into the cup through the end wall thereof and is biased against the curl on the hinge pin. The biasing action of the resilient tongue frictionally retains the door in an open position and, after the door has been swung part way toward its closed position, the tongue swings the door the rest of the way closed and yieldably holds the door in its closed position.

These and other objects and advantages of the invention will become more apparent from the following detailed description when taken in conjunction with the accompanying drawings.

DETAILED DESCRIPTION OF THE PREFERRED EMBODIMENT

Figure 1:
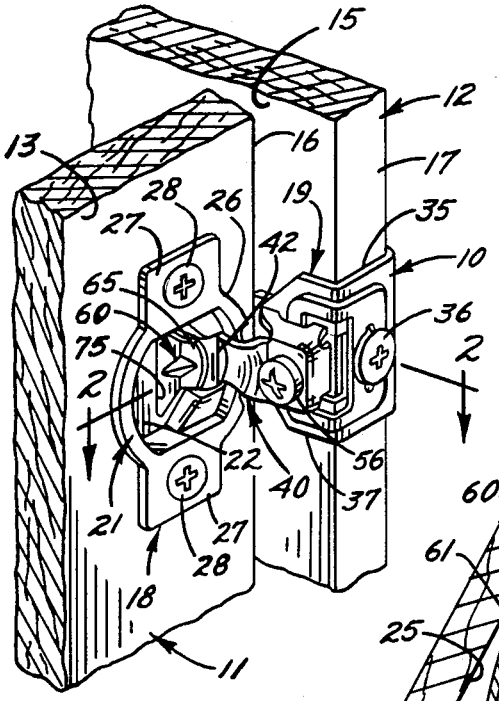
FIG. 1 is a fragmentary perspective view showing a cabinet door swingably mounted on a cabinet frame by a new and improved hinge incorporating the unique features of the present invention.

For purposes of illustration, the hinge 10 of the present invention is shown in the drawings as being used for mounting a substantially solid door 11 made of wood or other non-metallic material for swinging between open and closed positions on the frame 12 of a kitchen cabinet. In this instance, the door is of the overlay type in that, when the door is closed, the inner and outer face surfaces 13 and 14 of the door overlap the outer face surface 15 of the frame while the hinged edge surface 16 of the door is spaced laterally from the adjacent parallel edge surface 17 of the frame.

Figure 2:
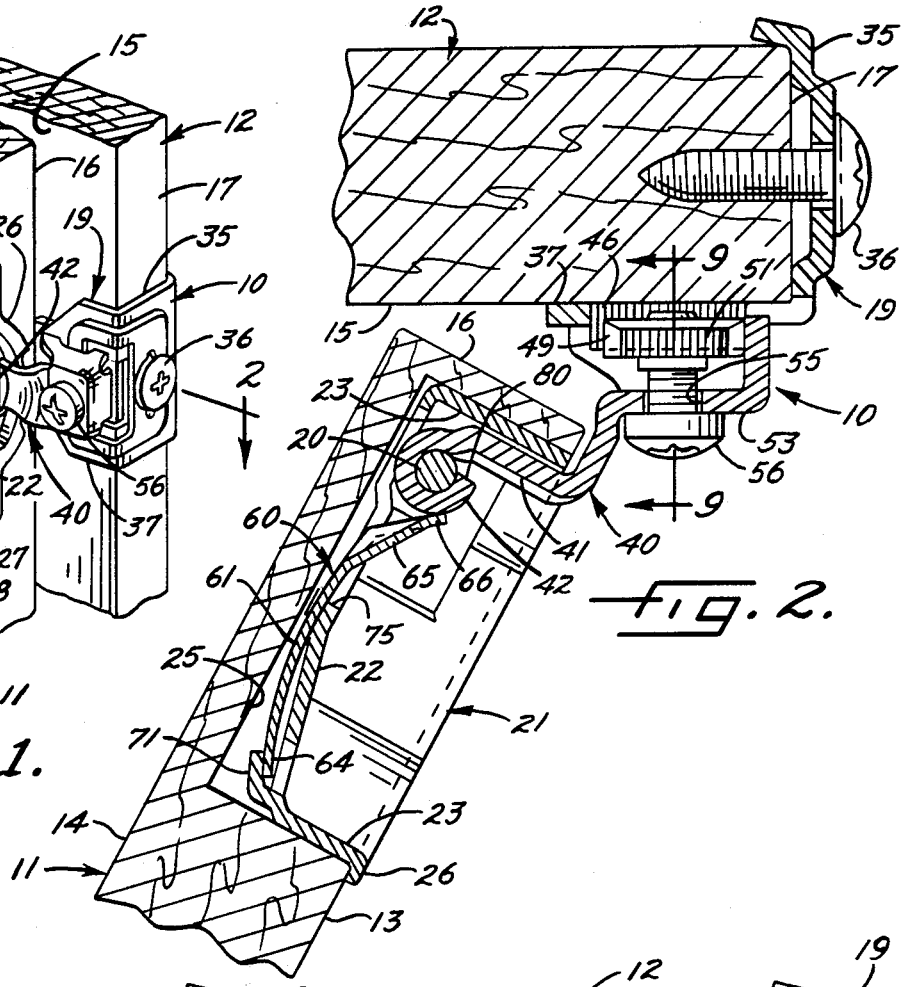
FIG. 2 is an enlarged fragmentary cross-section taken substantially along the line 2—2 of FIG. 1 and shows the door, in a fully open position.

The hinge 10 comprises door and frame members 18 and 19 adapted to be mounted on the door 11 and the frame 12, respectively, and connected by an upright hinge pin 20 which serves to mount the door member for swinging relative to the frame member. The hinge pin is supported by the door member 18 which, in this instance, comprises a stamped metal cup 21 having a generally circular shape. As shown in FIG. 2, the cup 21 is defined by an axially facing end wall 22 and by an annular side wall 23 formed integrally with and projecting inwardly from the end wall. A cylindrical bore or pocket 25 is formed in the inner face surface 13 of the door, terminates short of the outer face surface 14 thereof and receives the cup 21 so as to enable a radially extending flange 26 at the inner edge of the annular wall 23 to lie substantially flush with the inner face surface 13. Two radially extending mounting wings 27 (FIG. 1) also are formed integrally with the inner edge of the annular wall 23 of the cup 21 and are disposed face-to-face with the door in the same plane as the flange 26. Screws 28 extend through the mounting wings to fasten the door member 18 of the hinge securely to the door.

Figure 5:
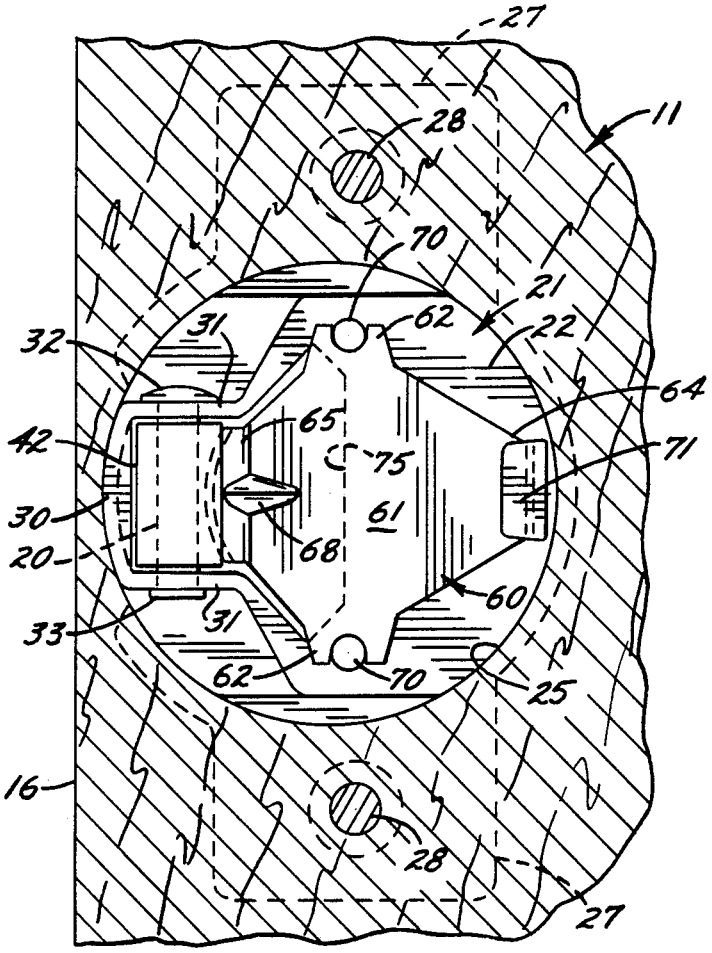
FIGS. 5 and 6 are enlarged fragmentary cross-sections taken substantially along the lines 5—5 and 6—6, respectively, of FIG. 4.
Figure 6:
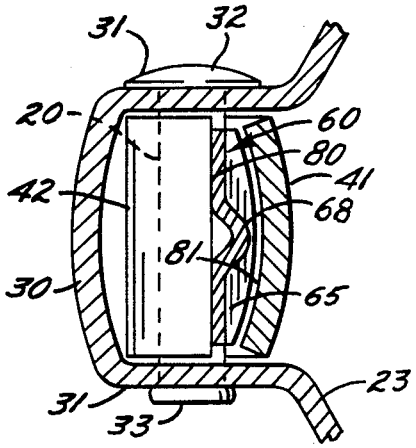

As shown in FIGS. 5 and 6, the outer portion of the cup 21 includes a substantially U-shaped stirrup 30 which is located in the pocket 25 adjacent the edge surface 16 of the door 11. The upper and lower legs 31 of the stirrup are formed with alined holes which receive the hinge pin 20. Herein, the hinge pin is in the form of a rivet having an upper head 32 and a swaged lower end 33. The latter clamps the pin tightly to the stirrup so that the pin and the cup are connected to pivot as a unit. The stirrup 30 is formed by suitably shaping part of the end wall 22 and the annular wall 23 of the cup 21.

Figure 8:
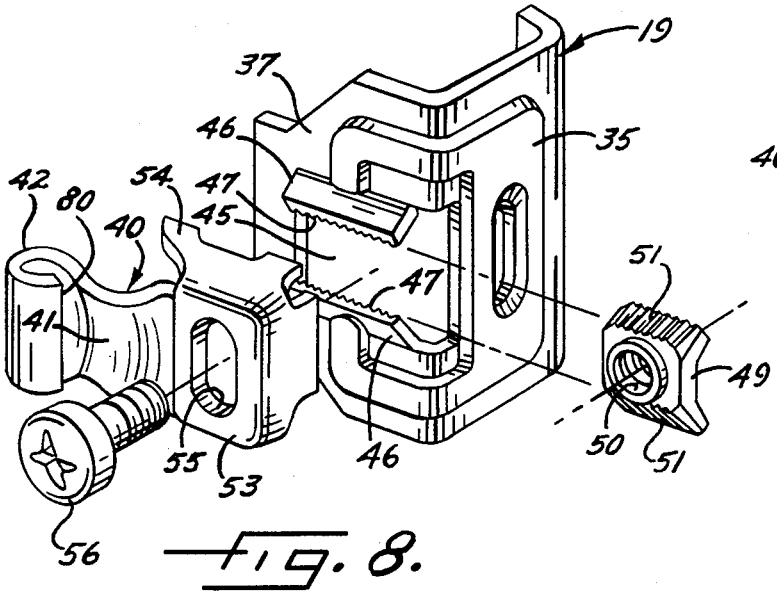
FIG. 8 is an exploded perspective view of certain parts of the hinge.

The frame member 19 of the hinge 10 includes a stamped metal mounting wing 35 (FIG. 2) which lies against the edge surface 17 of the frame 12 and which is adapted to be fastened to the frame by a screw 36. A second wing 37 (FIGS. 1 and 8) is formed integrally with and is disposed at right angles to the wing 35 and lies against the outer face surface 15 of the frame. An arm 40 with multiple bends is secured to the wing 37 and includes an elongated free end section 41 (FIG. 2) which extends into the cup 21 and whose free end portion is bent into a circular configuration to form a curl 42. The latter pivotally receives the hinge pin 20 and is located between and closely adjacent the legs 31 of the stirrup 30 so as to be captivated axially with respect to the hinge pin (see FIGS. 5 and 6). By virtue of the pivotal connection effected between the hinge pin and the curl, the door 11 is supported on the frame 12 to swing between a fully open position shown in FIG. 2 and a fully closed position shown in FIG. 4.

Figure 9:
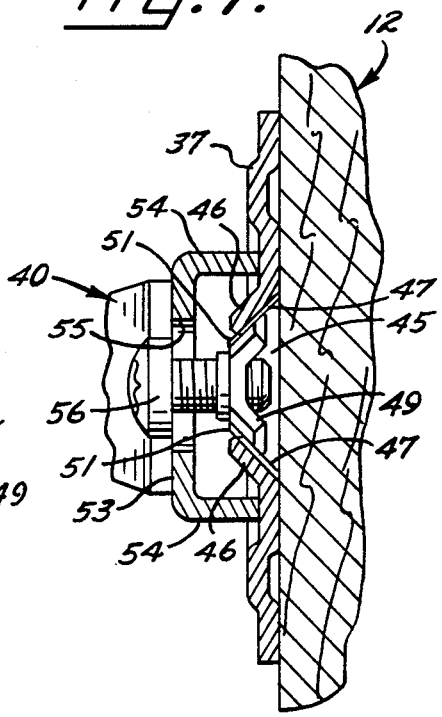
FIG. 9 is a fragmentary cross-section taken substantially along the line 9—9 of FIG. 2.

To enable the door 11 to be installed on the frame 12 and adjusted to a proper position relative to the opening in the frame, the arm 40 of the hinge 10 is adapted to be adjusted coordinately relative to the mounting wing 37. For this purpose, the wing 37 is formed with an opening or "window" 45 (FIGS. 8 and 9) whose upper and lower edge portions define lips 46 which are inclined outwardly and which are formed with serrated inner surfaces as indicated at 47 in FIG. 8. A nut 49 with a threaded hole 50 is adapted to slide edgewise into the window 45 and to be adjusted horizontally to different lateral positions relative to the frame 12. Serrations 51 on the upper and lower inclined edges of the nut coact with the serrations 47 on the lips 46 to help hold the nut in a selected laterally adjusted position.

The end portion of the arm 40 opposite the curl 42 is formed with a generally dish-shaped mounting section 53 (FIGS. 8 and 9) having upper and lower flanges 54 which straddle the lips 46. A vertically elongated hole 55 is formed through the mounting section 53 and is sized to receive a screw 56 which is adapted to be threaded into the hole 50 in the nut 51. When the screw is loosened from the nut, the elongated hole 55 enables the arm 40 to be shifted vertically relative to the wing 37 thereby to permit vertical adjustment of the door 11 on the frame 12. In addition, the nut 49 may be shifted laterally within the window 45 to enable lateral adjustment of the door. Once the door has been properly adjusted in both coordinate directions, the screw 56 may be tightened to clamp the flanges 54 to the wing 37 and, at the same time, to draw the inclined and serrated edges 51 of the nut into wedging engagement with the inclined and serrated inner sides 47 of the lips 46 and thereby anchor the door in its adjusted position.

Figure 4:
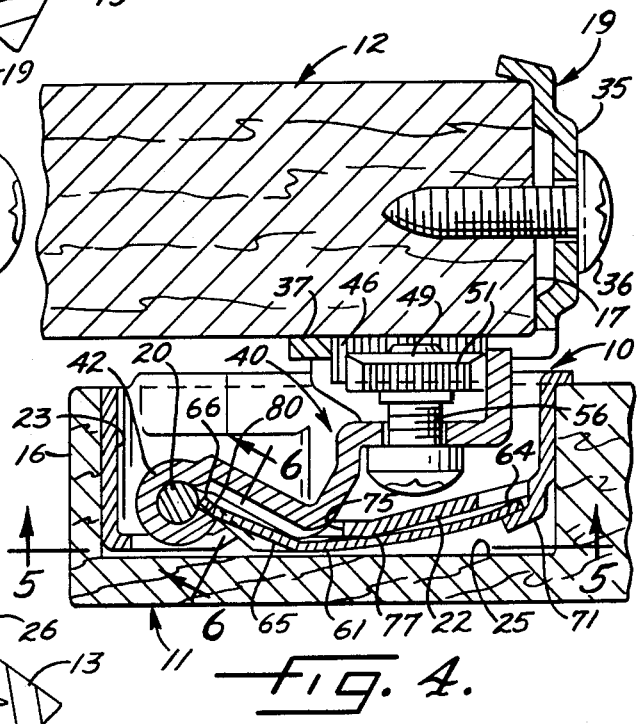
FIG. 4 also is a view similar to FIG. 2 but shows the door in a fully closed position.

When the door 11 is in its fully closed position, virtually the entire arm 40 is disposed within and is concealed by the cup 21 (see (FIG. 4). In addition, the cup conceals the frame wing 37. Since the cup itself is located within the pocket 25 in the door, the entire hinge 10 is concealed with respect to the front face 14 of the door and is virtually invisible from the edge surface 16 of the door.

In accordance with the present invention, a relatively simple leaf spring 60 (FIG. 7) is carried by the cup 21 and bears against the curl 42 to effect self-closing of the hinge 10 after the door 11 has been swung part way toward its closed position. By virtue of using the leaf spring 60, a concealed hinge 10 of the cup-type may be constructed as a self-closing hinge without need of encumbering the hinge with bulky and relatively complex and expensive coil springs, rollers, plungers and the like.

Figure 7:
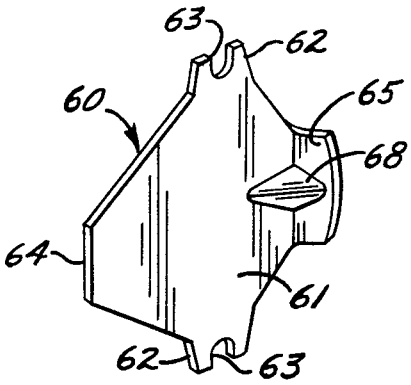
FIG. 7 is a perspective view of the leaf spring.

The leaf spring 60 is shown most clearly in FIG. 7 and comprises a substantially flat plate portion 61 made of resiliently yieldable soft tempered steel. Ears 62 with U-shaped notches 63 are formed integrally with and project vertically from the upper and lower edges of the plate 61 about midway along the length of the plate and are disposed in the plane of the plate when the spring 60 is in an unstressed position. The upper and lower edges of the plate taper toward one another as they progress away from the ears and, at one end of the plate, the plate is of relatively narrow width as indicated at 64 in FIG. 7.

In carrying out the invention, a tongue 65 (FIG. 7) is formed integrally with and extends inwardly from the opposite end of the plate 61 of the spring 60. When the spring is in an unstressed position, the tongue is inclined relative to the outer side of the plate 61 at an angle of about 20 degrees. The extreme free end portion 66 (see FIG. 2) of the tongue 65 extends inwardly from the outer side of the main length of the tongue at an additional angle of about 20 degrees when the spring is in a fully relaxed condition. To strengthen the junction between the plate 61 and the tongue 65 against fatigue, a gusset 68 (FIG. 7) extends across the junction. The gusset is formed by dimpling portions of the plate and the tongue outwardly along the horizontal centerline of the spring.

For the most part, the plate 61 of the spring 60 is disposed alongside the outer side of the end wall 22 of the cup 21 and is located between the end wall and the inwardly facing upright surface of the pocket 25 in the door 11. To locate the spring on the cup, two generally circular bosses 70 (FIG. 5) are coined outwardly from the cup and receive the notches 63 of the ears 62. In addition, a substantially L-shaped tab 71 (FIGS. 4 and 5) is struck outwardly from the end wall 22 of the cup 21 and captivates the narrow end portion 64 of the spring 60.

Pursuant to the invention, the tongue 65 and the adjacent portion of the plate 61 of the spring 60 extend into the cup 21 through an opening 75 formed in the end wall 22 of the cup so as to enable the free end portion 66 of the tongue to bear against the curl 42. Herein, the opening 75 in the end wall 22 begins at the stirrup 30 and stops approximately at the bosses 70, the opening gradually widening in a vertical direction as it progresses from the stirrup toward the bosses (see FIG. 5). Part of the plate 61 of the spring overlies part of the opening 75.

As shown most clearly in FIG. 4, the end wall 22 of the cup 23 slopes inwardly as the end wall progresses from the opening 75 toward the tab 71. By virtue of such sloping, the end wall defines a fulcrum at 77 which coacts with the tab 71 to cause the plate 61 of the spring 60 to bow outwardly when the tongue 65 of the spring is deflected into and through the opening 75 and is placed in engagement with the curl 42. As a result, the free end portion 66 of the tongue tends to spring outwardly and is loaded resiliently against the curl.

When the door 11 is in its fully open position shown in FIG. 2, the free end portion 66 of the tongue 65 of the spring 60 bears against a full arcuate portion of the curl 42. As a result of the tongue pressing against the curl, there is frictional resistance opposing free swinging of the door 11 and thus the door tends to remain in the position to which it is opened. When the door is fully open, the inner face surface 13 of the door is disposed at an angle of about 120 degrees relative to the outer face surface 15 of the frame 12, further opening of the door being stopped by virtue of the inner edge of the annular wall 23 of the cup 21 engaging the inner side of the elongated portion 41 of the arm 40.

Figure 3:
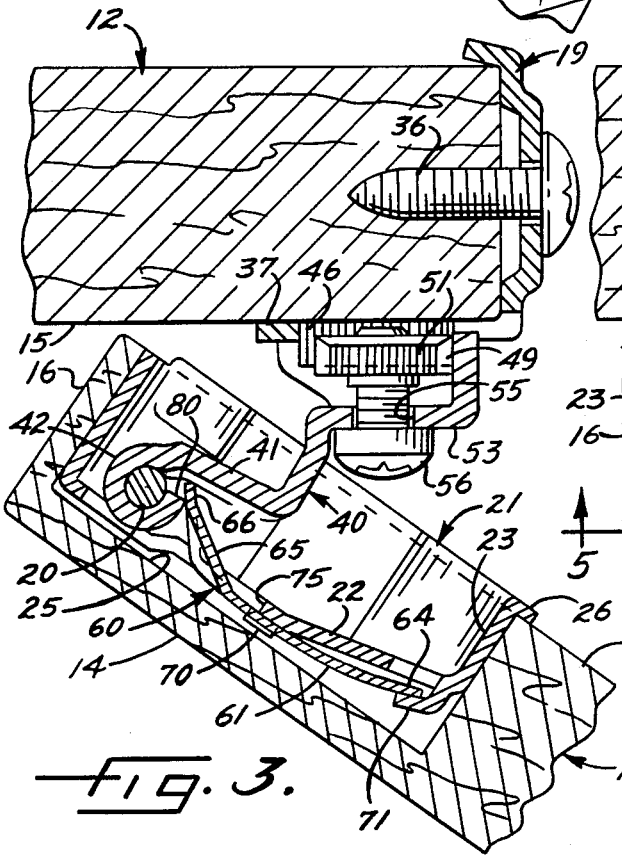
FIG. 3 is a view similar to FIG. 2 but shows the door in a partially open position.

As the door 11 is swung from its fully open position toward its closed position, the free end portion 66 of the tongue 65 of the spring 60 rides around the curl 42 and continues to frictionally resist free movement of the door until the door reaches an angle of about 35 degrees relative to the frame 12 (see FIG. 3). At this position, the free end portion 66 of the tongue 65 leaves the full arcuate surface of the curl 42 and begins bearing against the free vertical edge 80 of the curl. As the tongue leaves the arcuate surface of the curl, energy stored in the spring 60 is released and acts through the tongue 65 and the free edge 80 of the curl to snap the door to its fully closed position shown in FIG. 4. In the fully closed position of the door, the free end portion 66 of the tongue 65 lies substantially in face-to-face relation with the free edge 80 of the curl 42 and defines a resilient latch for holding the door closed. Before the door may be opened, sufficient force must be exerted on the door to cam and deflect the tongue 65 past the free edge 80 of the curl and into engagement with the arcuate surface of the curl. Such deflection loads the spring so that the spring may subsequently effect self-closing of the door as the latter next approaches its closed position.

As shown in FIG. 6, the outer side of the elongated portion 41 of the arm 40 is formed with a concave radius 81. The radius enables the tongue 65 to clear the elongated portion of the arm as the tongue moves to the positions shown in FIGS. 3 and 4.

From the foregoing, it will be apparent that the present invention brings to the art a new and improved concealed self-closing hinge 10 of the cup-type in which the self-closing action is effected by a simple and inexpensive leaf spring 60. Because the mounting plate 61 of the spring is located on the outer side of the end wall 22 of the cup 21 while the tongue 65 extends into the cup through the opening 75, the spring may be bowed and resiliently loaded and yet does not encumber the interior of the cup or interfere with the arm 40.

I claim:

1. A concealed self-closing hinge for mounting a door for swinging on a fixed frame, said hinge comprising a door member having a cup defined by an end wall and by an annular wall formed integrally with and projecting inwardly from said end wall, said end wall having inner and outer sides, means formed integrally with said cup for mounting said door member on said door, a hinge pin supported by said cup adjacent said annular wall and having at least a portion located inwardly of the end wall of the cup, said hinge further comprising a frame member having a wing for mounting said frame member on said frame, an arm having one end attached to the wing of said frame member and extending into said cup, a curl on the opposite end of said arm and wrapped around said hinge pin to connect said door and frame members pivotally to one another, and a spring for urging said door member to and releasably holding said door member in a closed position with respect to said frame member, said spring comprising a single piece of resiliently yieldable material formed separately of said cup and having a generally flat plate portion secured to and lying along the outer side of the end wall of said cup, an opening formed through said end wall adjacent said hinge pin, and said spring further comprising a tongue portion formed integrally with and bent inwardly from said plate portion and extending inwardly through said opening and into said cup to bear against and ride on said curl.

2. The combination of, an upright door, a fixed frame and a concealed self-closing hinge for mounting the door for swinging on the frame about an upright axis and between open and closed positions, the door having inner and outer sides and being formed with a pocket which opens out of the inner side of the door and which includes an upright and inwardly facing surface, said hinge comprising a door member having a cup disposed within said pocket, said cup having an upright end wall located face-to-face with the upright surface of said pocket and having an annular wall formed integrally with and projecting inwardly from said end wall, said end wall having inner and outer sides, upwardly and downwardly projecting mounting wings formed integrally with the inner edge of said annular wall and secured to said door, an upright hinge pin supported by said cup adjacent said annular wall and having at least a portion located inwardly of the end wall of the cup, said hinge further comprising a frame member having a mounting wing secured to said frame, an arm having one end attached to the mounting wing of said frame member and extending into said cup, a curl of the opposite end of said arm and wrapped around said hinge pin to connect said door and frame members pivotally to one another and permit said door to swing between open and closed positions relative to said frame, and a spring acting on said curl and causing said door to be urged to and held releasably in its closed position, said spring comprising a single piece of resiliently yieldable material formed separately of said cup and having a generally flat plate portion secured to said cup, said plate portion lying between the upright surface of said pocket and the outer side of said end wall and being disposed in opposing relation with the outer side of said end wall, an opening formed through said end wall adjacent said hinge pin, part of the plate portion of said spring overlying part of said opening, and said spring further comprising a tongue portion formed integrally with and bent inwardly from said plate portion and extending inwardly through said opening and into said cup, said tongue portion bearing against said curl and riding on said curl when said door is swung between said open and close positions.

* * * * *